US006502369B1

(12) United States Patent
Andison et al.

(10) Patent No.: US 6,502,369 B1
(45) Date of Patent: Jan. 7, 2003

(54) METHOD OF SUPPORTING PLASTIC CONTAINERS DURING PRODUCT FILLING AND PACKAGING WHEN EXPOSED TO ELEVATED TEMPERATURES AND INTERNAL PRESSURE VARIATIONS

(75) Inventors: David Andison, Oakville (CA); Steven Scheffer, Burlington (CA)

(73) Assignee: Amcor Twinpak-North America Inc. (CA)

( * ) Notice: Subject to any disclaimer, the term of this patent is extended or adjusted under 35 U.S.C. 154(b) by 83 days.

(21) Appl. No.: 09/696,314

(22) Filed: Oct. 25, 2000

(51) Int. Cl.[7] ..... B65B 31/02; B65B 31/04

(52) U.S. Cl. ..... 53/432; 53/84; 53/275; 53/361; 53/467; 53/485

(58) Field of Search ..... 53/84, 85, 106, 53/108, 110, 275, 361, 561, 575, 577, 578, 579, 467, 485, 490

(56) References Cited

U.S. PATENT DOCUMENTS

| | | | | | |
|---|---|---|---|---|---|
| 2,694,516 | A | | 11/1954 | Barnby et al. | 226/82 |
| 3,299,607 | A | | 1/1967 | Dopp et al. | 53/87 |
| 3,897,670 | A | * | 8/1975 | Hansen | 425/524 |
| 3,969,455 | A | * | 7/1976 | Moller | 156/69 |
| 4,176,153 | A | * | 11/1979 | Weiler et al. | 264/524 |
| 4,407,340 | A | | 10/1983 | Jensen et al. | 141/67 |
| 4,450,878 | A | | 5/1984 | Takada et al. | 141/48 |
| 4,583,346 | A | | 4/1986 | Kameda | 53/431 |
| 4,588,000 | A | | 5/1986 | Malin et al. | 141/1 |
| 4,662,154 | A | | 5/1987 | Hayward | 53/431 |
| 4,703,609 | A | | 11/1987 | Yoshida et al. | 53/431 |
| 5,033,254 | A | | 7/1991 | Zenger | 53/431 |
| 5,251,424 | A | | 10/1993 | Zenger et al. | 53/431 |
| 5,622,579 | A | * | 4/1997 | Tobias | 156/285 |

* cited by examiner

*Primary Examiner*—John Sipos
*Assistant Examiner*—Hemant M. Desai
(74) *Attorney, Agent, or Firm*—Mark Kusner; Michael A. Jaffe

(57) ABSTRACT

A method of supporting a plastic container exposed to elevated temperatures during product filling and packaging to eliminate heat and internal pressure induced distortion, internal vacuum distortion, or structural failure. Plastic containers usually have a body with exterior configuration and a sealable open mouth. The invention provides a method of hot filling, pasteurising and retort processing of conventional containers during product filling where at least a portion of the container is confined in a support casing having an interior cavity mating the exterior configuration of the container body portion. The product is then introduced into the container, and the container mouth is sealed. A positive pressure is induced within the sealed container while the container is exposed to a product processing temperature. An unsupported PET container exposed to high heat and internal pressure variations would distort or fail. However, the external mating support casing together with positive internal pressure restrains the PET container during this period of high stress and low resistance thereby preventing distortion or failure. Afterwards, by cooling the container to a casing release temperature below the product processing temperature and then releasing the container from the casing, eliminates container distortion problems.

12 Claims, 6 Drawing Sheets

METHOD OF SUPPORTING PLASTIC CONTAINERS DURING PRODUCT FILLING AND PACKAGING WHEN EXPOSED TO ELEVATED TEMPERATURES AND INTERNAL PRESSURE VARIATIONS

TECHNICAL FIELD

The invention relates to a method of supporting a plastic container exposed to the combination of internal pressure variations and elevated temperatures during product filling and packaging thereby eliminating distortion induced by the heat and internal pressure.

BACKGROUND OF THE ART

Plastic containers for packaging foods have been widely accepted in some applications, such as soft drinks, bottled water and juices, due to their well known advantages over conventional glass and metal containers. Substantial reductions in weight and the low cost of using plastic containers creates circumstances where it is highly desirable to expand the application of plastic containers if possible to other areas in packaging. However, in many cases, conventional use of plastic containers results in problems when the plastic containers are exposed to an elevated temperature which reduces the plastic strength, internal vacuum which collapses a container, or high internal pressures combined with heat which tends to bulge or distort the plastic walls of the container to an acceptable degree. To date plastic containers have not replaced conventional use of glass bottles or jars for packaging many food products, which are pasteurized or retort processed after filling the container.

Thermal distortion of the container may cause unacceptable bulging of the side walls, bottom surface distortion can cause the container to lean to one side, distortion of the bottle neck area can create problems in sealing the containers after hot filling, expansion of the side walls can cause difficulty in attaching labels and any distortion of the container detracts from the aesthetic appeal of the packaging itself.

There have been attempts to modify blow moulded polyester containers or PET bottles in order to enable hot filling or retort processing with limited success. For example, heat setting of the plastic container or co-extrusion of heat resistant materials with other less costly resins have been applied however at significantly increased cost and increased manufacturing cycle time. In heat treating, the thermoplastic material is subjected to heat wherein the crystal structure is changed to increase the heat resistance to heat distortion of the final package.

In general however, heat setting and addition of heat resistant materials involve unacceptable increases in costs that detract from the principle advantages of using plastic containers.

In the case of hot filling of plastic containers, the conventional manner of dealing with a resultant negative or vacuum pressure within the plastic container is to use specially designed vacuum panels in the lateral sides of the bottle or in the bottom surface which bow inwardly to deform and accommodate the product shrinkage and negative internal pressure. Large collapsible panels in the sidewalls of PET containers severely restrict the design of the package itself and limit the application of labels. Also the expense of specially designed dies, maintenance of separate bottle inventory for hot fill applications and moulding machine change over costs result from using a different bottle design for different product processing methods.

As is known in the art, hot fill applications involve heating of comestible products to a temperature approximately 140° F. to 205° F. (60° C. to 96° C.), placing the hot product in the container and sealing the container. During cooling of the product however, the hot product and hot gas in the head space shrink in volume. Cooling after sealing therefore creates a negative internal pressure or vacuum within the final filled container. Further shrinkage of the product occurs if the package is refrigerated below ambient temperature for storage. Without collapsible vacuum panels in the side of the plastic container, the resulting pressure differential creates a net external pressure causing the container to buckle or collapse inwardly, sometimes referred to as "paneling".

Therefore, conventional methods of adapting plastic containers to products which are heated during processing and packaging have met with limited success. Disadvantages include the risk of heat distortion which can be addressed by specially designed vacuum collapsing panels or relatively expensive heat set and heat resistant containers.

In the case of hot filled aluminium cans, it is well-known that negative internal pressure caused by hot filling can be counteracted by adding liquefied nitrogen gas or dry ice immediately before sealing the aluminium container. During this process the nitrogen or carbon dioxide gas created on contact with the hot product creates a positive pressure within the sealed aluminium container. The relatively high strength aluminium container can resist a high internal pressure during processing. When the product cools, the shrinkage of the product and negative pressure resulting is countered by a greater positive pressure created by the gas within the sealed container to produce a residual net positive pressure in the final container. Examples of this prior art process are described in U.S. Pat. No. 4,703,609 to Yoshida et al. and U.S. Pat. No. 4,662,154 to Hayward.

Attempts have been made to apply the same technology to plastic containers with limited success. U.S. Pat. No. 5,251,424 to Zenger et al. describes essentially the same process applied to hot filling of a plastic PET container. In Zenger, the hot filled product is poured into a plastic bottle, liquid nitrogen is dosed into the hot product immediately before closing the container and the container is permitted to cool to storage temperature. Normally, a hot filled product will shrink and create a vacuum within the plastic container which conventionally has been addressed with vacuum panels. However, Zenger et al. describes a method of increasing internal positive pressure through use of liquid nitrogen gas which counteracts the negative pressure created on cooling of the hot filled product.

In theory, the Zenger et al. method permits a conventional PET plastic container to be used for hot filling applications, which results in cost savings. However, in practice it has proved extremely difficult to implement. The accurate dosing of liquid nitrogen or solid dry ice to the precision required for use of plastic containers has proved illusive.

As is apparent to those skilled in the art, by nature a heat formable blow-moulded plastic bottle is very sensitive to variations in the heat absorbed by the material. The uniformity of plastic container composition and the uniformity of heat of the hot filled product are such that it is extremely difficult to predict with sufficient accuracy the performance of the hot filled plastic container. Variations in product density, heat distribution, and physical forces applied to the product filled plastic container during handling and packaging operations can have significant effect on the performance when dosed with liquid nitrogen to increase the internal pressure.

Further, the accurate dosing of liquid nitrogen gas or solid dry ice into the product prior to capping is extremely difficult to accomplish with the required accuracy. In the case of liquid nitrogen, the size of a liquid drop can vary significantly and the volume of liquid nitrogen required is in the order of one or two drops only. The inherent inaccuracy is not a particular difficulty when the packaging has a high margin of safety in its strength such as for example in the dosing of product packed in aluminium cans.

In the case of PET plastic containers however the packaging when heated is at a significantly reduced structural strength due to the heat sensitivity of plastic materials. As well, the dosed product when capped subjects the packaging to the most extreme internal pressure that it will experience in its service life. When the gas forms to create a high internal pressure, the packaging is heated and has a reduced strength, the container is also subjected to hydrostatic forces from the liquid product within the container and is usually in transit on conveyors or otherwise subjected to external physical forces or acceleration/deceleration forces.

In conclusion, therefore, the method proposed by Zenger et al. in U.S. Pat. No. 5,251,424 in theory can counteract the negative vacuum pressure created by a cooling hot filled product with a positive pressure from liquid nitrogen gas forming an expanding gas. However in practice there are a number of inaccuracies inherent in the dosing of liquid nitrogen as well as the precise handling and temperature of the product and bottle during the processing. The combination of peak internal pressure and minimum package resistance to internal pressure caused by elevated temperatures results in deformation of the plastic packaging to an unacceptable degree. Lack of predictability, and waste of materials and product have resulted in failure of the Zenger method in commercial applications.

For example, the inventors conducted a test of the Zenger et al. method with the following results. A 600-ml. heat set PET bottle with a petaloid base was filled with water at 185° F. One gram of dried ice was quickly deposited within the hot water and the bottle was capped within several seconds. The hot filled bottle was left at rest on a horizontal surface with no lateral supports or restraints. The bottle base experienced severe roll out within several seconds of capping, presumably as a result of the combination of increased internal pressure and decreased strength of the PET bottle due to elevated temperatures. The deformed bottle was then quenched in cold water, however the deformed base remained rolled out after quenching and cooling. When the bottle was opened, there was no residual internal pressure remaining in the bottle. The lateral sides of the body of the bottle had triangulated indicating that the product on cooling had decreased in volume and created an internal vacuum which collapsed the sides of the bottle into a triangular shape.

It is an object of the invention, to provide a method by which plastic containers can be utilized in packaging products which require exposure to the combination of elevated temperatures and internal pressure variations during processing.

It is a further object of the invention to avoid the disadvantages of the prior art in utilizing plastic containers including avoidance of heat set plastic containers which are relatively expensive, avoidance of relatively heavy walled plastic containers which are also expensive compared to conventional bottles, and avoidance of use of relatively expensive high strength plastics.

It is a further object of the invention to utilize conventional PET plastic containers without vacuum collapsible panels or other special features in a hot-fill, pasteurized or retort process thereby using the conventional plastic containers during product filling and packaging when exposed to both elevated temperatures and internal pressure variations without experiencing deformation or structural failure.

Further objects of the invention will be apparent from review of the disclosure and description of the invention below.

DISCLOSURE OF THE INVENTION

A method of supporting a plastic container exposed to elevated temperatures during product filling and packaging to eliminate heat and internal pressure induced distortion, internal vacuum distortion, or structural failure. Plastic containers usually have a body with exterior configuration and a sealable open mouth. The invention provides a method of hot filling, pasteurising and retort processing of conventional plastic containers during product filling where at least a portion of the container is confined in a support casing having an interior cavity mating the exterior configuration of the container body portion. The product is then introduced into the container, and the container mouth is sealed. A positive pressure is induced within the sealed container while the container is exposed to a product processing temperature. An unsupported PET container exposed to high heat and internal pressure variations would distort or fail. However, the external mating support casing together with positive internal pressure restrains the PET container during this period of high stress and low resistance thereby preventing distortion or failure. Afterwards, by cooling the container to a casing release temperature below the product processing temperature and then releasing the container from the casing eliminates container distortion problems.

A significant advantage of the invention is that it enables use of the conventional non-heat set bottles with no special moulds and no special material to create containers for use in hot filling, pasteurisation or retort processing.

A primary benefit is in a reduction in material costs. Conventional (non-heat set) soft drink type bottles weigh substantially less than relatively heavy heat set bottles. Adopting the method of the invention, such conventional soft drink bottles can be used for hot filling, pasteurisation or retort processing thus replacing heat set bottles.

Increased bottle moulding productivity also results since mould machines can output more lightweight soft drink type bottles per mould per hour than heat set bottles. Heat setting requires longer mould residence time and thus decreases bottle moulding cycle output.

The invention also increases design freedom providing more options to the designer than with typical heavy weight heat set bottles. Use of conventional bottles that can be filled using the hot filling, pasteurisation or retort process, as well as used to package soft drinks or other products by conventional methods has significant beneficial results on decreased material costs, increased productivity, increased design freedom, reduced inventory, reduced storage requirements, improved scheduling and reduced mould maintenance costs.

The soft drink and packaged drink markets are extremely seasonal with high demand during summer periods, which require stock piling in advance of the peak period to meet the peak demand. Storage of finished bottles in order to meet the customer's orders during peak periods is a significant expense and involves considerable risk on the part of the bottle manufacturer. Conventional hot-filled bottles require specialized collapsible vacuum panels and individual moulds. Therefore, conventionally the stock piling of different bottle designs are required in order to meet peak demand. By utilising the same bottles for soft drinks and hot fill applications, significant savings in inventory expense, storage as well as mould design and maintenance are highly advantageous results of the invention.

In manufacturing of containers, the elimination of specialized designs is a significant advantage. Identical moulds can be used thereby reducing tooling, down time and change over costs. Use of identical moulds avoids the need for maintenance of specialized moulds for different products.

Minor changes to filling machine operations are required in order to accommodate the external bottle restraints and addition of liquid nitrogen or dry ice. It is expected that in many cases the lateral restraints can simply take the form of a light weight plastic armour, sleeve or tube casing that is wrapped around the bottles as they are conveyed with conventional equipment that contacts only the bottle finish or spout area. Bottles and other containers are generally conveyed and handled using only the neck or rim portion of a container. In blow moulded bottles especially, the finish mouth and neck portion are significantly thicker material than the blow moulded body portion due to the blow moulded manufacturing method. The thicker areas are able to resist the internal pressure and elevated temperatures without external support or restraint. The thinner base area and sidewalls are supported or restrained without interfering with conventional handling equipment.

As a result the invention permits the market expansion of plastic containers into the areas that are conventionally served by glass and metal containers such as retort processing of foods. Increased design freedom, lower manufacturing costs, lower weight and shipping costs and simplification of inventory for manufacturing and storage result.

Using conventional methods such as proposed in U.S. Pat. No. 5,525,124 to Zenger et al., the PET container must be designed to be free standing and resist maximum internal pressure at the same time as the container is subjected to maximum heat. When exposed to heat the container has significantly reduced capacity to resist the internal pressure and deformation exactly when the maximum life cycle capacity is required.

Using conventional methods, the bottle must be over designed to avoid deformation and collapse during processing since maximum lifetime stress on the bottle results from the coincidence of maximum internal pressure and maximum exposure to heat (i.e. minimum container strength).

The invention on the other hand provides means to support and reinforce the container during the maximum stress and maximum heat period during processing. Once the container has survived the peak internal pressure and maximum heat exposure during processing, the container is not required to exhibit the same maximum resistance during storage and transport. The invention provides means to temporarily reinforce the bottle during maximum internal pressure and heat exposure. This method allows use of conventional bottles or containers, that have performed satisfactorily for soft drinks and cold filled products, to be used for hot filled, pasteurised and retort processed products.

Utilising the method of the invention successfully avoids the permanent deformation and distortion which results from use of conventional bottles for these heat inducing processes in the prior art.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Although the drawings and description relate to a conventional PET bottle of configuration commonly used for soft drinks, it will be understood that the invention equally applies to any plastic container such as a plastic jar or wide mouth plastic body where containers are exposed to elevated temperatures during product filling and packing coincident with internal positive pressure. The method of the invention is not limited to an particular type of plastic container and can be equally applied to PET, polyethylene, polypropylene, PEN, multi-layer bottles and other plastic containers.

Figure 1:
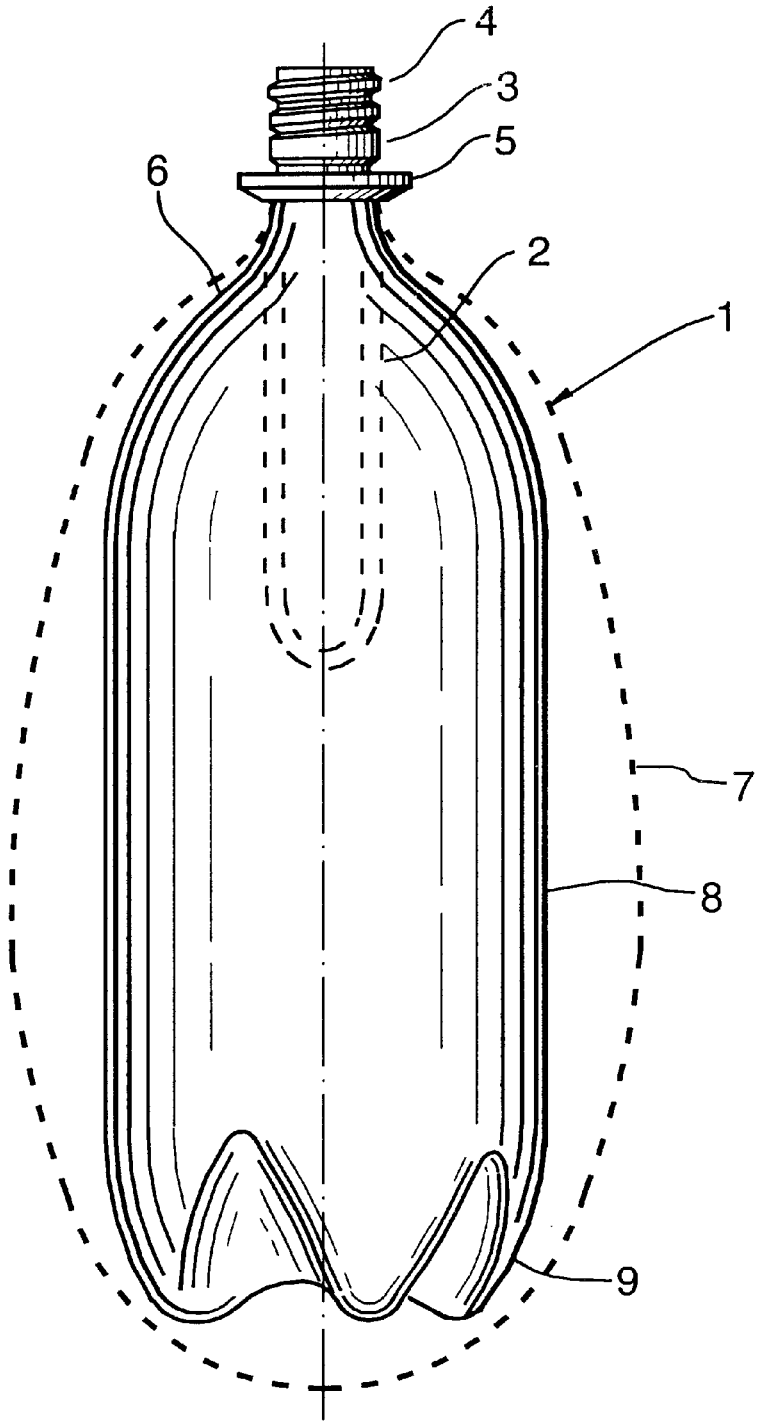
FIG.1 (PRIOR ART)
FIG. 1 illustrates a conventional PET blow moulded plastic container used for packaging soft drinks and showing internally in dashed outline the preform from which the blow moulded body is conventionally formed, and externally in dashed outline showing the conventional unsatisfactory distortion caused by use of prior art methods in hot filling and dosing with liquid nitrogen, including lateral expansion of the entire blow moulded bottle apart from the neck finish and showing rollout of the petaloid base.

Referring to FIG. 1, a conventional PET plastic container of configuration used for packing soft drinks is shown. The plastic container 1 is conventionally blow moulded from an injection moulded preform 2 with finish 3 including threaded spout 4 and neck flange 5. The finish and neck are generally of much greater wall thickness than the lower body, which has been stretched and thinned during blow moulding. Conventional handling equipment for filling the bottles engages only the neck 6, neck flange 5 and finish 3.

Figure 2:
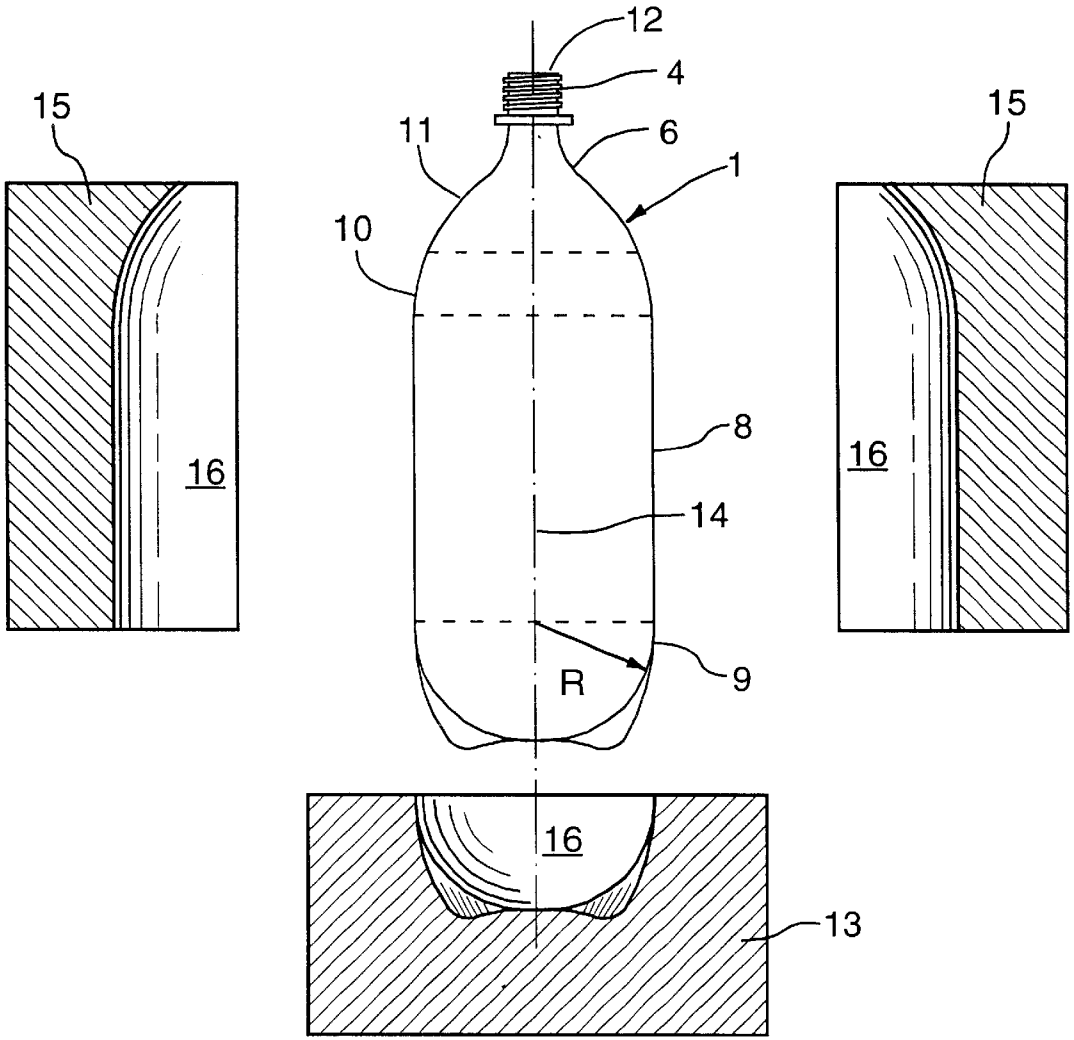
FIG. 2 illustrates a schematic view of a three-part support casing for a conventional PET soft drink container used for hot filled juices for example, with left and right mould-like bodies and base section.

FIG. 1 also shows in dashed outline the distorted shape 7 that results in using prior art methods of hot filling, for example. Increased internal pressure and heat exposure results in similar distortion, known as "roll out" as illustrated in FIG. 1. The conventional plastic container 1 shown includes a cylindrical mid body portion 8 and petaloid base 9 that (as indicated in FIG. 2) is generally spherical of radius R with hollow extending legs to provide a flat base support. In general, the moulds for forming the bottle during blow moulding include a separate base portion which is withdrawn axially and two or more side portions which are withdrawn radially or laterally (mould portions not shown).

The invention relates to a method of supporting the plastic container 1 when it is exposed to elevated temperatures during product filling and packaging. With reference to FIG. 2, the container 1 has a body of a selected exterior configuration in the example shown with a generally spherical base 9, cylindrical mid body 8 and transition sections 10 and 11 leading to a narrow neck 6 with threaded spout 4 and sealable open mouth 12.

Figure 3:
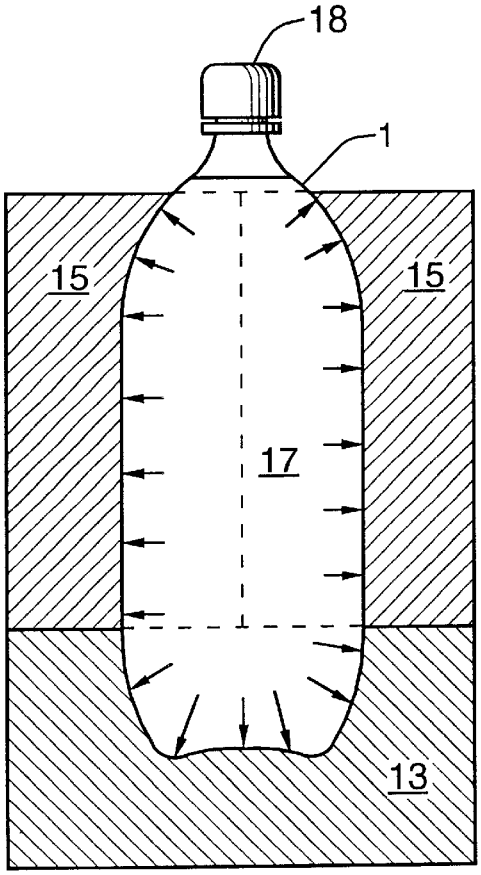
FIG. 3 shows a like view to FIG. 2, with the three-part support casing assembled together to confine the body within an interior cavity mating the exterior configuration of the bottle body and resisting internal pressure created by dosing with liquid nitrogen within the capped container.

As indicated in a comparison between FIGS. 2 and 3, the method of the invention improves over the prior art by confining at least a portion (9, 8, 10, 11) of the container 1 in the support casing (13, 15, 19) having an interior cavity 16 closely fitting or mating the exterior configuration of the associated body portion. In the embodiment shown in FIG. 2, the support casing comprises a base support casing 13 which is withdrawn and engaged along a longitudinal axis 14 of the bottle 1. The support casing also includes two lateral support casings 15 which are withdrawn radially or laterally in a manner similar to the blow moulding moulds conventionally used.

As will be appreciated by those skilled in the art, FIG. 2 merely shows a schematic representation and depending on the materials used for the support casings 13 and 15, the actual wall thickness may be significantly thinner than that shown. As well, it will be apparent that the interior finish of the interior cavities 16 of the support casings 13 and 15 need not be of the same surface finish quality as a mould, for example. The casings 13 and 15 merely provide support to the walls of the plastic container 1 in close contact during processing steps where interior pressure is relatively high and the container 1 is exposed to elevated temperatures. As suggested in FIG. 3, close contact between the external surface of the plastic container 1 is necessary to resist the internal pressure (indicated by several arrow lines) when the product 17 fills the interior of the container 1 and the container is capped with a closure 18. Various means can be provided to ensure that the support casing components 13 and 15 remain in position engaging the external surface of the container to maintain the moulded configuration of the container 1 until the product 17 has cooled sufficiently. Various quick release closures or fastener devices can be included and have not been shown since these are implicit to those skilled in the art.

Figure 4:
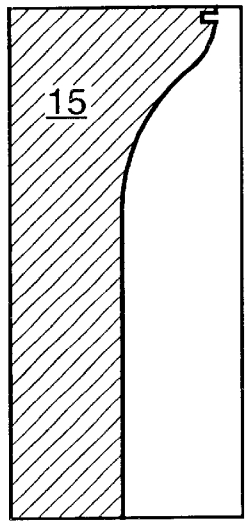
FIGS. 4 and 5 show alternative lateral support casings to replace the lateral support casings of FIG. 3 in cases where container design or packaging processing necessitate containment of the container neck and cap.
Figure 5:
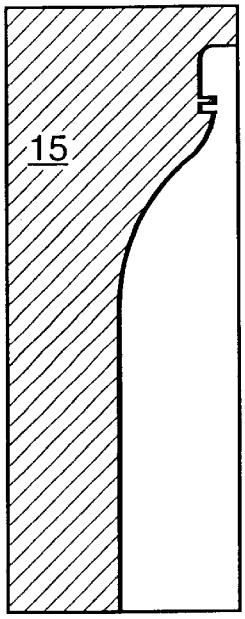

Alternative lateral support casing designs 15 are shown in FIGS. 4 and 5. Depending on the need to laterally restrain the upper portions 6, 10, and 11 of the container 1, and the need to access the open mouth 12 of the container, lateral support casings 15 can be adapted to extend upwards and restrain the entire neck 6 as in FIG. 4, or can envelope the entire cap 18 as in FIG. 5 if the container is capped before restraint.

Figure 6:
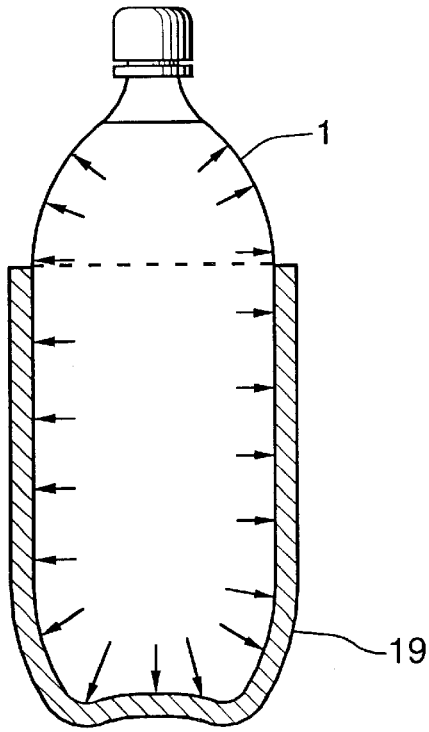
FIG. 6 shows an alternative support casing made of one-piece sleeve, slipped on axially from the base which may suffice where minimal support of the exterior configuration is required due to relatively low internal pressure or high container resistance.

A further simple alternative sleeve casing 19 is shown in FIG. 6. Depending on the inherent strength of the plastic container, the internal pressure and degree of heat to which the container is exposed and the structural rigidity of the sleeve casing 19, it may prove necessary to merely support the cylindrical mid body portion 8 and spherical base 9 as illustrated in FIG. 6. In some cases it may only be necessary to support the cylindrical mid body 8 with an open cylindrical sleeve 19 (not shown).

As suggested in FIG. 1, the combination of internal or external heat, and internal pressure from nitrogen dosing or carbonation with hydrostatic pressure of the liquid product 17 can and does distort the entire body of the bottle 1 including the cylindrical mid-body wall 8, transition sections (see FIGS. 2–10, 11) and domed petaloid base 9 of the container 1. The upper neck portion 6 of the container 1 is usually of greater wall thickness than the stretched lower portions 8 and 9. As a result, the top portions of the bottle 6, 10, 11 have higher resistance tointernal pressure and heat exposure. As indicated in FIG. 6, in some cases it may be unnecessary to support the upper portions 10, 11 and 6 during product filling processing. As well, due to the greater ability of a spherical structure to resist internal pressure, such as the base 9, compared to the cylindrical body 8, in some cases it may not be necessary to support the base 9 either.

In all cases, the method applied in accordance with the invention exposing the container to a positive internal pressure within the sealed container 1 that serves to maintain the container shape while exposing the container to an elevated product processing temperature that reduces structural strength.

For example, in the hot filling process, the product is introduced into the container 1 in a hot state but below boiling point for water at atmospheric pressure. Generally, hot filled products are filled into the container at 140° F. to 205° F. (60° C. to 96° C). Internal positive pressure is induced by dosing with liquid or solid gases that forms a pressurized gas within the closed container1.

In the case of some liquid products such as beer or carbonated beverages containing juice, the containers 1 are filled and closed before heating. These beverages are bottled with an initial positive pressure within the closed container 1. During subsequent heating of the closed container 1, further internal pressure may be induced due to expansion of the gas within the closed container 1. In such cases, there is no vacuum formed upon cooling of the product, due to the initial positive internal pressure, and hence there is no need to include the step of nitrogen dosing.

During post-fill pasteurization processing, the temperature of the product is raised to approximately 140° F. (60° C.) after the product has been deposited into the container and the container has been sealed. The container and product are cooled and to counteract the vacuum created on cooling when the product is not carbonated, the pasteurization process in accordance with the invention includes dosing with liquid nitrogen or dry ice prior to sealing the container. Where the product to be pasteurized already exerts a positive internal pressure, such as a carbonated beverage or beer, there is no need to include the step of nitrogen or dry ice dosing.

In the retort process, a product is deposited into the container 1. The container is sealed and afterwards the sealed container is exposed to heat sufficient to sterilize the contents usually in excess of 100° C. Retort processing often involves placing sealed containers within a pressure vessel and exposing the sealed containers to super heated pressurized steam within the pressure vessel in a manner similar to a pressure cooker or autoclave.

In the cases of hot filling, and retort, a positive pressure is induced within the sealed container by nitrogen or dry ice dosing and the container is exposed to elevated processing temperatures. In the case of carbonated beverages and beer, although there is an initial positive pressure within the initially closed container that counteracts the vacuum created on cooling, once the closed container is heated, further increases in internal pressure may be induced by the expansion of contained gas within the heated closed container that are resisted by the support casing 13, 15 or 19. In conventional hot filling processing, as disclosed in U.S. Pat. No. 5,251,424 to Zenger et al., the product is initially poured into the container 1 hot, for example at 85° C., and the product is dosed with liquid nitrogen or dry ice immediately prior to sealing the container. A positive pressure is induced by the formation of gas on contact with the hot product which serves to counteract the vacuum created by cooling of the hot product later in the process.

Therefore as indicated in FIGS. 3 to 6 at least a portion of the container susceptible to deformation is confined in a support casing 13, 15 or 19 specifically having an interior cavity which mates the exterior configuration of the confined body portion very closely. Large gaps or uneven surfaces in the support casings would jeopardize the container to undesirable permanent distortion or surface finish damage in local areas.

The sequencing of the step to confine the container 1 can vary and is selected from: (1) prior to introducing the product into the container 1; (2) prior to sealing the container mouth 12 with the cap 18; (3) prior to creating a positive pressure within the sealed container; or (4) subsequent to creating a positive pressure within the sealed container. In the case of hot filling, for example, the heat emitted from the hot product by itself in many cases may be sufficient to distort the container 1 and therefore it is expected that in most hot filling applications the container will be confined within the support casing before introduction of the product into the container and before a positive pressure is induced by dosing with liquid nitrogen or dry ice. On the other hand, in the case of retort processing, the product is often filled into the container at room temperature or within a range of temperatures that the container 1 can accommodate without requiring the reinforcing of a support casing. It is expected in the case of retort processing that the container will be filled at or about room temperature and capped before confining in the support casing. In the case of retort processing the support casing is required to resist internal positive pressure which is induced when the product is heated to a sterilizing temperature within the sealed container.

In all cases after the internal pressure has been raised while the container is exposed to a product processing temperature for the required period of time for product integrity, the container is cooled to a casing release temperature below the product processing temperature. Depending on the specific design of the container the casing can be released at a point where the positive pressure has decayed and temperature has reduced to where the container 1 by itself can resist the imposed stresses. At the casing release temperature, the container is removed from the casing and if required can be further cooled prior to storage and shipping.

In order to better explain the invention, details of two experiments are presented below.

EXPERIMENT No. 1

A 600 ml. heat set PET bottle with a petaloid base was laterally restrained within a blow moulding mould on a bench top. The heat set PET bottle was then filled with hot water at 185° F. and 1 gram of solid dry ice was deposited within the hot water prior to immediate capping. The hot filled bottle was maintained in the restraint for several hours until the bottle and water cooled to room temperature. On removal of the restraining support casing the bottle was found to be in excellent shape having experienced no base roll out and no permanent lateral body deformation. On removing the cap, it was apparent that the bottle had retained some residual pressure although the precise amount was not measured.

EXPERIMENT No. 2

In the second experiment, a 600 ml. non-heat set PET bottle with a petaloid base was restrained within a support casing also comprising a three part blow mould on a bench top, and was also filled with hot water at a 185° F. In this case, 2 grams of dry ice were deposited within the hot water immediately prior to capping within seconds. After the bottle and water had cooled to room temperature, the support casing was removed. The bottle again was found to be in excellent shape having experienced no roll out and no body deformation. On opening the cap, the bottle contained residual pressure although the precise amount was not measured.

As explained above, the confining of the container within a support casing is advantageous especially when the internal pressure and temperature are both at peak levels. The method allows for inaccuracy in dosing, and provides an increased margin of safety over the conventional Zenger (U.S. Pat. 5,251,424) method by reinforcing the container during the process stage with maximum internal pressure and maximum heat exposure (minimum strength).

Figure 7:
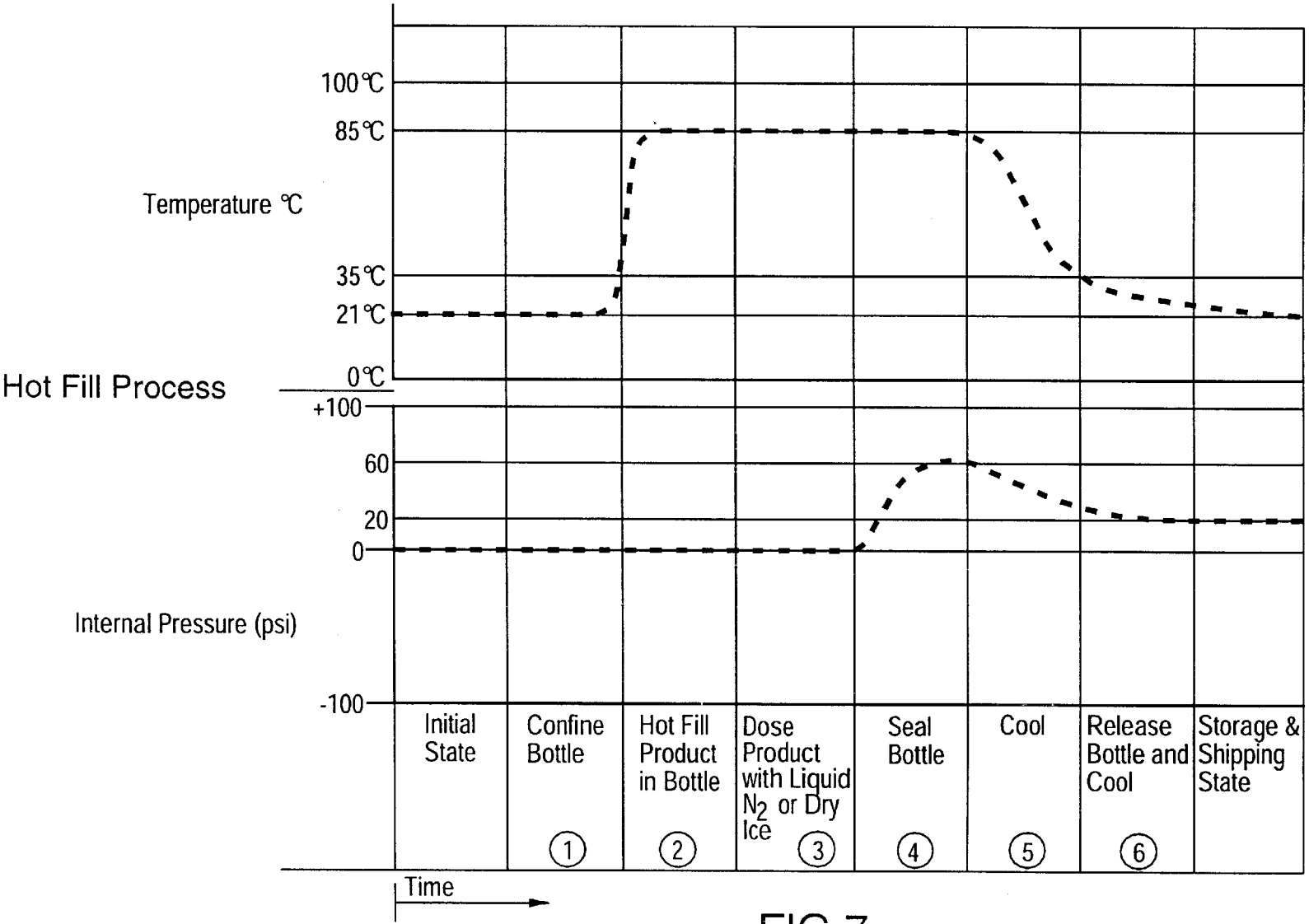
FIG. 7 is a schematic chart showing fluctuation of internal pressure and temperature during stages in a hot-fill method according to the invention, specifically to illustrate the coincidence of high internal pressure and high temperature resisted by the lateral and base confinement of the container within the support casings shown in FIG. 3 and alternatively FIGS. 4, 5 and 6.
Figure 8:
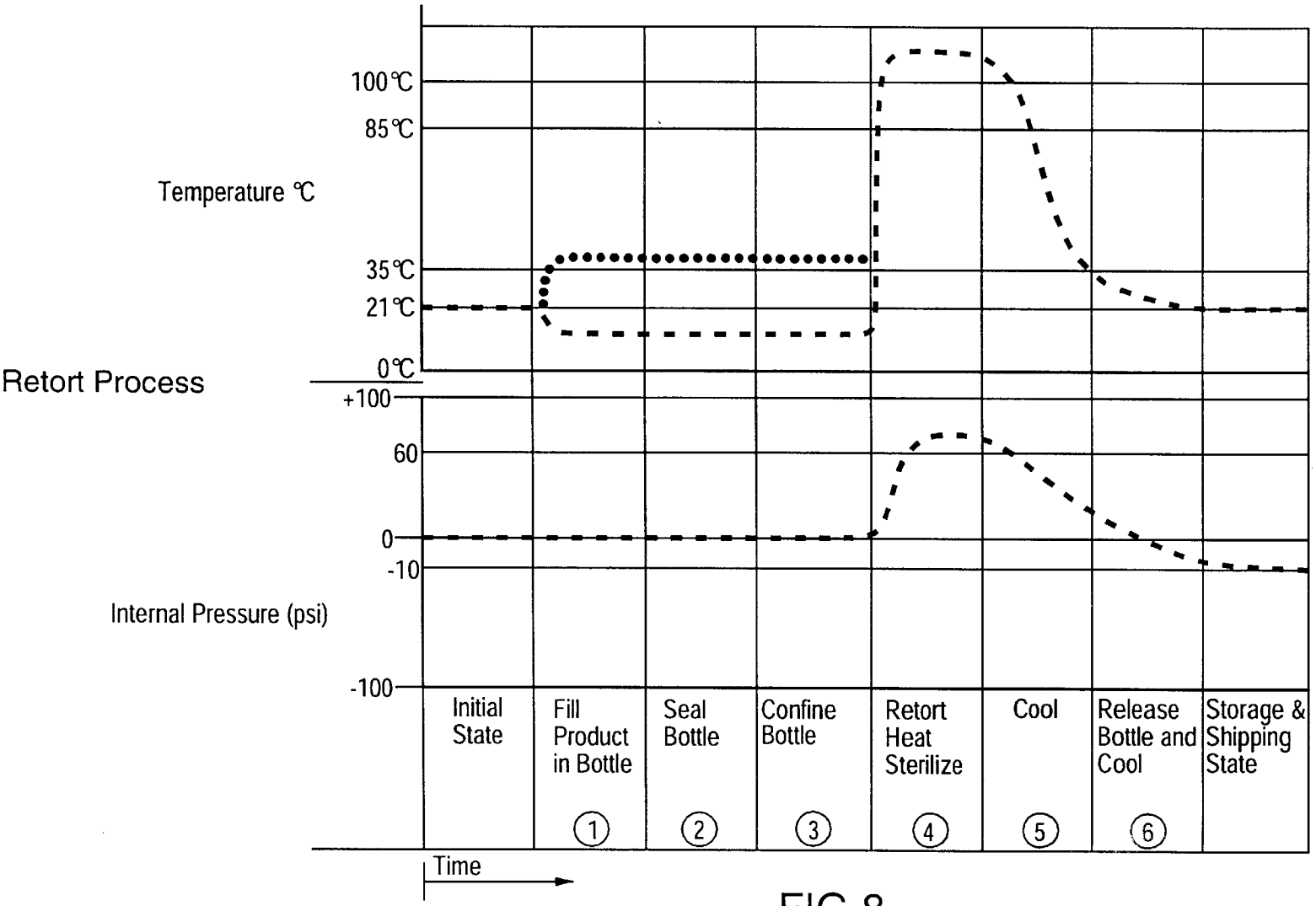
FIG. 8 shows a like schematic chart for the retort process which differs from the hot fill process in that during retort heat is applied to the product after filling and sealing of the container whereas in hot fill processing the product is filled into the open container while hot and then sealed afterwards.
Figure 9:
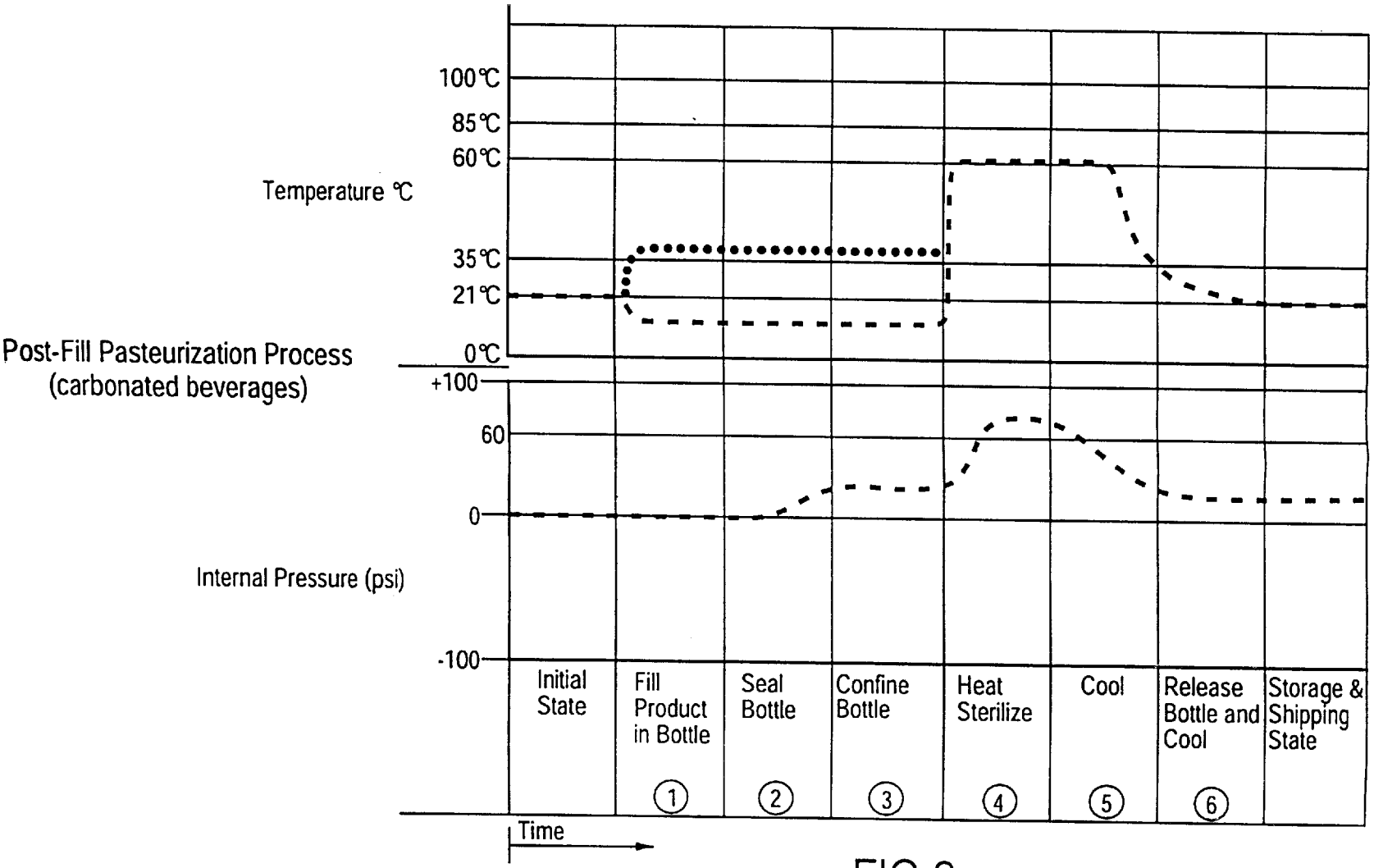
FIG. 9 shows a like schematic chart for the post-fill pasteurization process where a carbonated beverage is filled and then sealed in the container resulting in an initial internal positive pressure, and thereafter the container is heated to an elevated pasteurization temperature.

In order to illustrate this phenomenon, FIGS. 7, 8 and 9 show the relationship between internal pressure and temperature at various steps in the process for hot fill, retort and post-fill pasteurization processing respectively. The coincidence of maximum heat exposure and maximum internal pressure is visually indicated.

With reference to FIG. 7, at the initial state the open bottle 1 will have zero pressure (in this description meaning atmospheric pressure or ambient pressure) and the temperature will usually be room temperature within a manufacturing facility, shown as the usual room temperature 21° C. Since during hot filling the temperature of the product together with hydrostatic pressure may overwhelm the capacity of the plastic container, it is likely necessary in many cases to confine the bottle prior to hot filling, but not in all cases. Since the bottle remains open, the internal pressure remains at atmospheric (zero) and temperature remains at room temperature 21° C. However, during hot filling of the product in the bottle, the temperature of the bottle is raised rapidly to the temperature of the hot filled product 85° C. while the internal pressure remains zero. The product is quickly dosed with liquid nitrogen or dry ice. Immediately after dosing, the bottle is sealed and pressure rapidly rises as the liquid nitrogen or dry ice converts to a gas within a confined bottle. The temperature however remains relatively constant until the following step of cooling the product takes place. The support casing (15, 13, 19) can be provided with air or liquid cooling channels (not shown), which would enhance the speed of cooling if desired. It is not necessary to cool the bottle to room temperature or avoid all residual internal pressure since the bottle in an unsupported state is able to resist internal pressure and elevated temperatures within predictable limits.

In the illustration of FIG. 5, it is assumed that the casing release temperature is 35° C. wherein the bottle is released from the casing and continues to cool to room temperature for storage and shipping.

With reference to FIG. 8, the retort process involves filling and sealing the container before exposing the sealed container (with product inside) to a sterilizing heat within a pressurized retort vessel for example. As shown in FIG. 8 the initial state of the bottle is the same in that there is atmospheric zero pressure internally and the bottle is at room temperature 21° C.

The product itself may be slightly above or below room temperature depending on the needs of the process. In retort processing some components of the product may be cooked before packaging and therefore may be at a temperature above room temperature when filled into the bottle. Alternatively, the product may be refrigerated at a temperature below room temperature. In either case, the filled bottles or jars are sealed and then confined within the support casing before placing on trays and inserting into the retort pressure vessel chamber. Within the retort chamber the heat is raised above 100° C. by application of super heated steam in order to fully sterilize the product confined within the sealed container. As a result of the heat applied (as shown in the upper part of FIG. 6) the temperature of the container rises rapidly. The internal pressure also rises rapidly due to expansion of the product and formation of vapour during heating of the liquid product. After the retort process has been continued for a period of time to sterilize the product, the containers with product stored inside are rapidly cooled. Again the assumption made is that at some temperate above ambient (as illustrated in FIGS. 5 & 6 at 35° C., for example) the containers are capable of resisting the residual internal pressure at that temperature and containers are released from the support casing. The container continues to cool to room temperature for storage and shipping.

Thin walled blow moulded containers usually perform better in storage and shipping when they have a residual positive internal pressure that increases their structural rigidity and load capacity. Control of the residual negative or positive pressure once the process has been completed can be achieved by dosing with liquid nitrogen or dry ice as in the hot fill procedure immediately prior to sealing the bottle. When dosed with nitrogen the internal pressure will be increased for all stages subsequent to sealing of the bottle. As a result, the residual internal pressure can be controlled to achieve zero pressure or a positive pressure with the retort process for storage and shipping.

FIG. 9 illustrates the changes in internal pressure and temperature during the post-fill pasteurization process. Post-fill pasteurization is used when carbonated products such as beer or soft drink beverages containing juice must be heated after the product is sealed within the container. The initial state of the container is at atmospheric pressure and room temperature. The carbonated product once sealed within the container creates an initial positive internal pressure. To resist internal pressure and support the container during heat application, the container is confined within the support casing. Subsequent heating of the sealed container reduces the structural strength of the container and may also induce an increase in internal pressure due to gas expansion. Coincidence of maximum temperature and maximum internal pressure is shown visually. The container is then cooled to the release temperature (35° C. as shown) and the support casing is removed. A residual internal pressure results from carbonation.

The invention is also applicable to pasteurization processes where the product is hot-filled or heated in the container before sealing. In such cases the same dosing procedure as described in conjunction with the hot-filling process are followed.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A method of supporting a plastic container exposed to elevated temperatures during a product packaging cycle, the container having a container wall defining a body of a selected exterior configuration and a sealable open mouth, the method comprising:

introducing product into the container;

sealing the container mouth to retain the product within the container until after completion of the product packaging cycle;

confining at least a portion of the container in a support casing having an interior cavity mating the exterior configuration of said body portion;

after sealing and confining the container, simultaneously exposing the container to a maximum temperature and a maximum positive internal pressure within the sealed container, the maximum temperature and maximum positive internal pressure being the maximum values to which the plastic container is exposed during the product packaging cycle for a peak period of time;

cooling the container to a casing release temperature below the maximum temperature; and releasing the container from the casing.

2. A method according to claim 1 wherein the maximum positive internal pressure is created by introduction of a predetermined quantity of liquefied gas into the container prior to sealing and permitting the gas to vaporise within the sealed container.

3. A method according to claim 1 wherein the maximum positive internal pressure is created by introduction of a predetermined quantity of solidified gas into the container prior to sealing and permitting the gas to vaporise within the sealed container.

4. A method according to claim 1 wherein the maximum positive internal pressure is created by retort sterilisation processing of the product within the sealed container.

5. A method according to claim 1 wherein the maximum positive internal pressure is created by carbonation of the product.

6. A method according to claim 5 wherein the product is post-fill pasteurisation processed by heating the container at the maximum temperature after sealing and confining the container.

7. A method according to claim 1 wherein the product is pasteurisation processed by introduction into the container and then heating the product to the maximum temperature.

8. A method according to claim 1 wherein the maximum temperature is in the range of 140° F. to 205° F. (60° C. to 96° C. ).

9. A method according to claim 1 wherein the support casing has an open top and comprises a separable base section and separable side sections.

10. A method according to claim 1 wherein the containers comprise plastic blow moulded containers of plastic material selected from the group consisting of: PET, polyethylene, polypropylene, PEN, and multi-layer plastic.

11. A method according to claim 8 wherein the containers are heat treated PET containers.

12. A method according to claim 6 wherein the sterilising temperature is in the range of 140° F. to 205° F. (60° C. to 96° C.).

* * * * *